US010424281B2

(12) United States Patent
Taniguchi et al.

(10) Patent No.: US 10,424,281 B2
(45) Date of Patent: Sep. 24, 2019

(54) HAMMER UNIT AND KEYBOARD DEVICE

(71) Applicant: CASIO COMPUTER CO., LTD., Shibuya-ku, Tokyo (JP)

(72) Inventors: Hirokazu Taniguchi, Tachikawa (JP); Toshiya Kuno, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/921,534

(22) Filed: Mar. 14, 2018

(65) Prior Publication Data

US 2018/0277081 A1 Sep. 27, 2018

(30) Foreign Application Priority Data

Mar. 21, 2017 (JP) ..... 2017-054849

(51) Int. Cl.
*G10H 1/34* (2006.01)

(52) U.S. Cl.
CPC ..... *G10H 1/346* (2013.01)

(58) Field of Classification Search
CPC ..... G10H 1/346
See application file for complete search history.

(56) References Cited

U.S. PATENT DOCUMENTS 5,406,875 A * 4/1995 Tamai ..... G10H 1/344 84/433
5,828,015 A * 10/1998 Coulon ..... H01H 3/125 200/5 A
6,075,213 A * 6/2000 Ichiro ..... G10H 1/346 200/1 B
6,147,289 A * 11/2000 Kumano ..... G10C 3/12 84/423 R
6,617,502 B2 * 9/2003 Suzuki ..... G10C 3/16 84/423 R
6,713,751 B2 * 3/2004 Muramatsu ..... G10G 3/04 250/221
7,217,877 B2 * 5/2007 Funaki ..... G10C 3/12 84/433
7,514,613 B2 * 4/2009 Yamaguchi ..... G10C 3/12 84/236
7,550,659 B2 * 6/2009 Shimoda ..... G10C 3/12 84/251

(Continued)

FOREIGN PATENT DOCUMENTS

JP 04101595 U 9/1992
JP 2011232672 A 11/2011

(Continued)

*Primary Examiner* — Robert W Horn
(74) *Attorney, Agent, or Firm* — Holtz, Holtz & Volek PC

(57) ABSTRACT

A hammer unit for use in a keyboard device or the like includes a plurality of hammer arms which are respectively operated in response to key depression operations on a plurality of keys, and a hammer connecting section which has a length corresponding to array of the plurality of keys, is connected to the plurality of hammer arms to support the plurality of hammer arms in an arrayed state, and has mounting sections which are provided in a direction of the array in areas where the hammer arms are not connected, and by which the hammer connecting section is mounted to a keyboard chassis. As a result, the assembling workability is improved.

17 Claims, 7 Drawing Sheets

(56) References Cited

U.S. PATENT DOCUMENTS 7,582,821 B2 * 9/2009 Watanabe ..... G10C 3/12 84/423 R
7,858,863 B2 * 12/2010 Osuga ..... G10H 1/346 84/423 R
8,093,480 B2 * 1/2012 Yoshida ..... G10H 1/346 84/439
8,119,895 B2 * 2/2012 Kitajima ..... G10H 1/346 84/423 R
8,134,060 B2 * 3/2012 Taniguchi ..... G10H 1/346 84/423 R
8,766,075 B2 * 7/2014 Ishida ..... G10H 1/34 84/423 R
8,927,848 B2 * 1/2015 Kaneko ..... G10H 1/34 84/720
8,987,570 B2 * 3/2015 Osuga ..... G10H 1/346 84/433
9,384,715 B2 * 7/2016 Taniguchi ..... G10C 3/18
9,495,940 B2 * 11/2016 Hoshino ..... G10C 3/18
9,502,004 B2 * 11/2016 Ohba ..... G10C 3/22
9,583,086 B2 * 2/2017 Takata ..... G10H 1/34
10,115,382 B2 * 10/2018 Nishimura ..... G10C 3/12
10,304,422 B2 * 5/2019 Yaguchi ..... G10C 3/16
2013/0152769 A1 * 6/2013 Suzuki ..... G10H 1/34 84/719
2013/0180390 A1 * 7/2013 Ishida ..... G10H 1/34 84/745
2015/0090104 A1 * 4/2015 Osuga ..... G10H 1/32 84/744
2018/0233114 A1 * 8/2018 Ohba ..... G10B 3/12
2018/0277081 A1 * 9/2018 Taniguchi ..... G10H 1/346
2018/0277082 A1 * 9/2018 Suzuki ..... G10H 1/346
2018/0330705 A1 * 11/2018 Palmowski ..... G10H 1/346
2019/0019483 A1 * 1/2019 Kuno ..... G10H 1/346
2019/0019484 A1 * 1/2019 Taniguchi ..... G10C 3/12

FOREIGN PATENT DOCUMENTS

JP 2015034853 A 2/2015
JP 2016012075 A 1/2016

* cited by examiner

HAMMER UNIT AND KEYBOARD DEVICE

CROSS-REFERENCE TO RELATED APPLICATION

This application is based upon and claims the benefit of priority from the prior Japanese Patent Application No. 2017-054849, filed Mar. 21, 2017, the entire contents of which are incorporated herein by reference.

BACKGROUND OF THE INVENTION

1. Field of the Invention

The present invention relates to a hammer unit for use in a keyboard instrument such as a piano, and a keyboard device including the hammer unit.

2. Description of the Related Art

For example, a keyboard device is known which has a structure where keys are supported to be rotatable in a vertical direction by key supporting shafts on a keyboard chassis, and hammer members are provided on the undersurface of the keyboard chassis in a manner to be rotatable in the vertical direction, and rotated in response to key depression operations on the keys so as to apply action loads to the keys, as described in Japanese Patent Application Laid-Open (Kokai) Publication No. 2015-034853.

In this keyboard device, each hammer member includes a hammer arm, a weight section provided on one end of the hammer arm, a rotational center section provided in a middle portion of the hammer arm, and an interlocking section provided on the other end of the hammer arm so as to interlock with the key. In this case, the rotational center section is a shaft receiving section rotatably mounted on a supporting shaft in a hammer supporting section provided on the undersurface of the keyboard chassis.

SUMMARY OF THE INVENTION

In accordance with one aspect of the present invention, there is provided a hammer unit comprising: a plurality of hammer arms which are respectively operated in response to key depression operations on a plurality of keys; and a hammer connecting section which (i) has a length corresponding to array of the plurality of keys, (ii) is connected to the plurality of hammer arms to support the plurality of hammer arms in an arrayed state, and (iii) has mounting sections which are provided in a direction of the array in areas where the hammer arms are not connected, and by which the hammer connecting section is mounted to a keyboard chassis.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

Hereafter, a first embodiment of a keyboard device in which the present invention has been applied is described with reference to FIG. 1 to FIG. 4.

Figure 1:
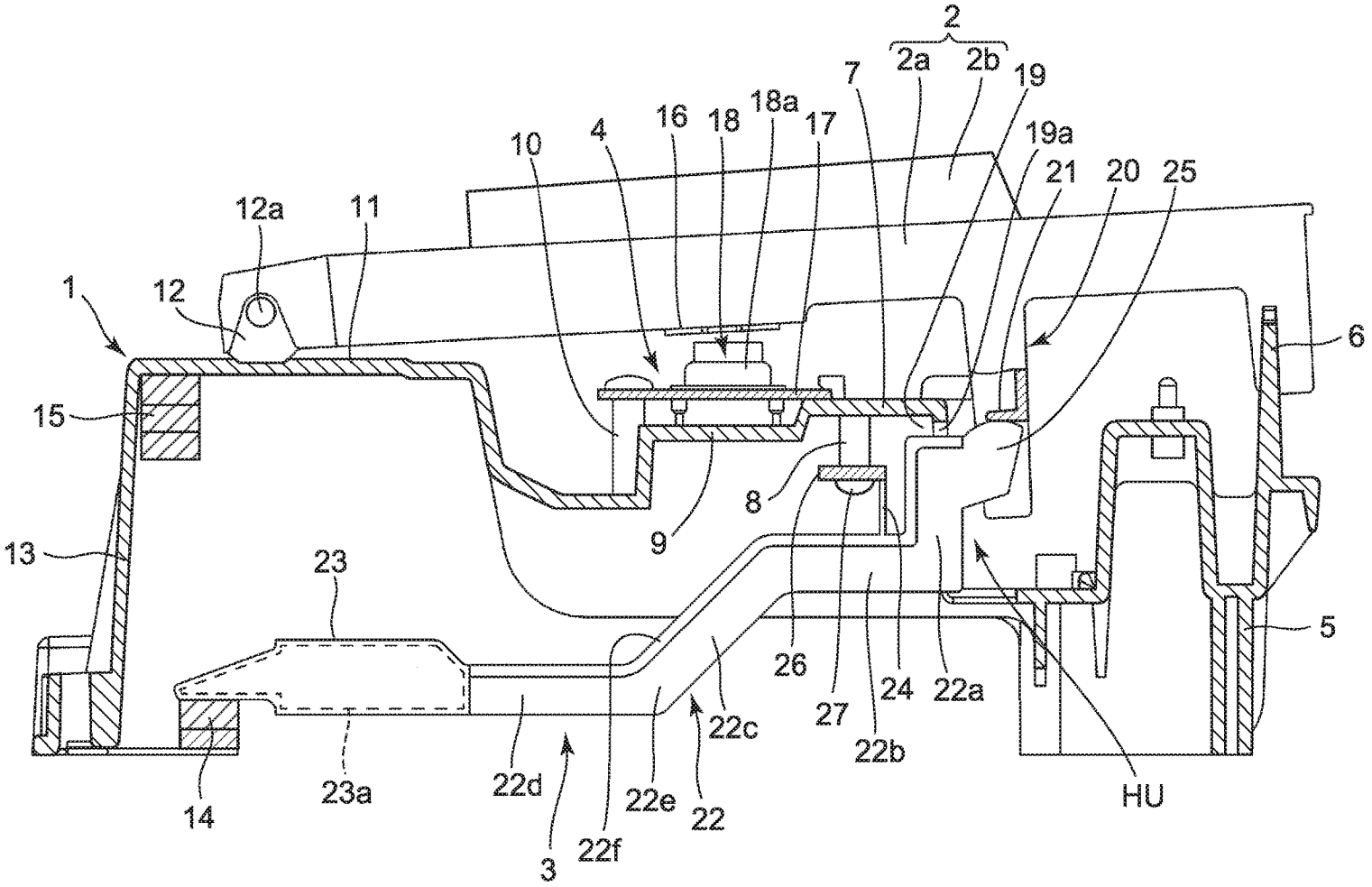
FIG. 1 is a cross-sectional view showing a first embodiment of a keyboard device in which the present invention has been applied.
Figure 2:
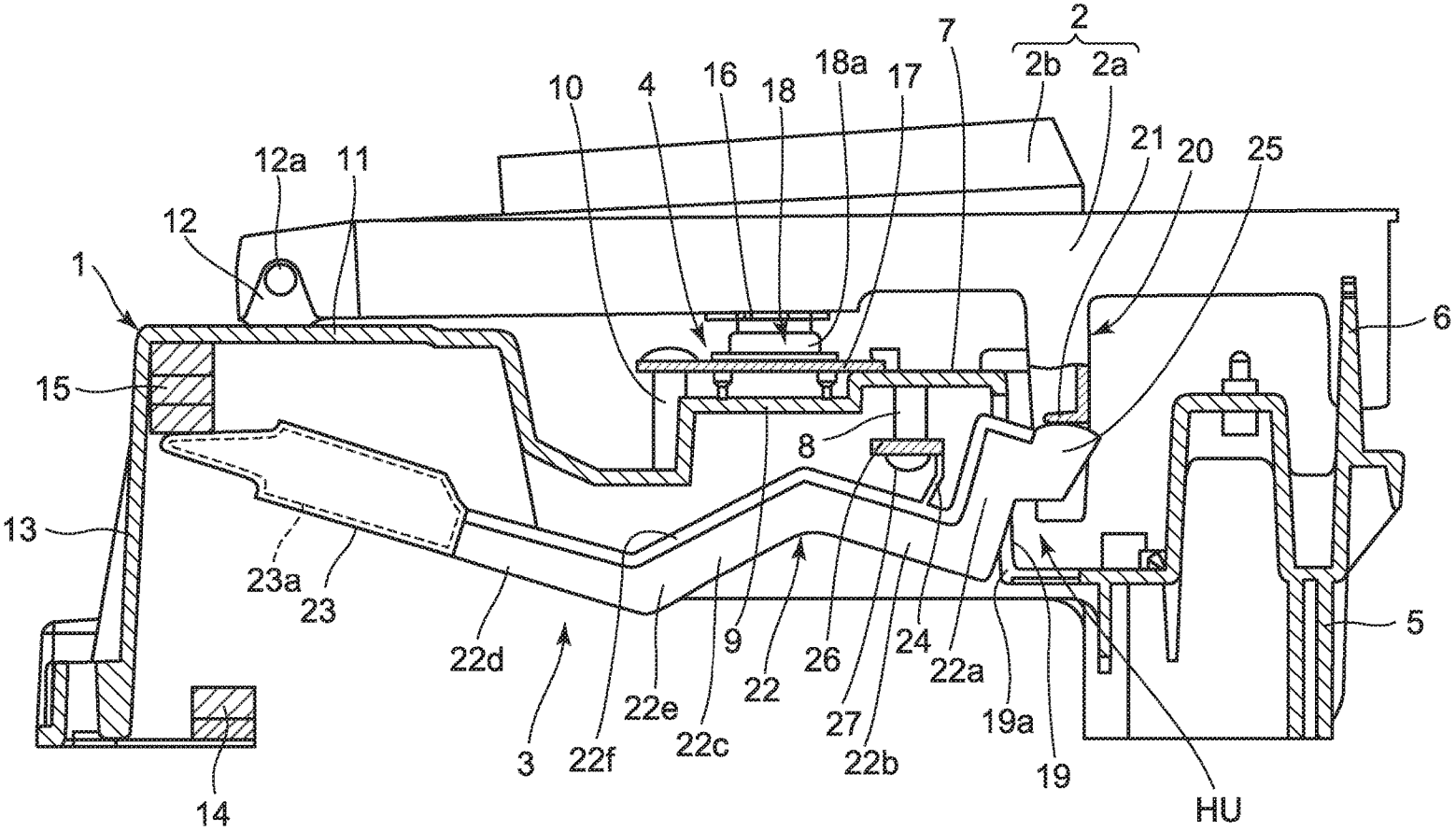
FIG. 2 is a cross-sectional view showing a state where a key has been depressed in the keyboard device shown in FIG. 1.

This keyboard device includes a keyboard chassis 1 made of synthetic resin, a plurality of keys 2 arranged on this keyboard chassis 1 in a manner to be rotatable in a vertical direction, a plurality of hammer members 3 which are rotated in response to key depression operations on the plurality of keys 2 so as to apply action loads to the keys 2, and switch sections 4 which output ON signals in response to key depression operations on the plurality of keys 2, as shown in FIG. 1 and FIG. 2.

The keyboard chassis 1 is arranged inside an instrument case (not shown). On a front end portion (a right end portion in FIG. 1) of this keyboard chassis 1, a front leg section 5 is provided projecting upward from its bottom, as shown in FIG. 1 and FIG. 2. On an upper portion of this front leg section 5, key guide sections 6 for preventing horizontal movements of the keys 2 are provided corresponding to the keys 2.

Also, in a substantially middle area of this keyboard chassis 1 in a front-rear direction (a left-right direction in FIG. 1), a hammer placing section 7 is provided at a position slightly higher than the front leg section 5, as shown in FIG. 1 and FIG. 2. On the undersurface of this hammer placing section 7, hammer mounting sections 8 where a later-described hammer connecting section 26 for the hammer members 3 is mounted is provided.

Also, on a rear end portion of the hammer placing section 7 of this keyboard chassis 1, a board mounting section 9 is provided to be one step lower than the hammer placing section 7, as shown in FIG. 1 and FIG. 2. Above this board mounting section 9, the switch section 4 is arranged across the hammer placing section 7 and a board supporting section 10. In this embodiment, the board supporting section 10 is provided upright on the rear side (the left side in FIG. 1) of the board mounting section 9.

Further, in a rear area of the keyboard chassis 1, that is, in an area behind the board mounting section 9, a key mounting section 11 is provided at a height substantially equal to an upper portion of the key guide section 6, as shown in FIG. 1 and FIG. 2. On the top surface of this key mounting section 11, a key supporting section 12 is provided projecting upward. The key supporting section 12 is provided with a key supporting shaft 12*a* which supports rear end portions of the keys 2 such that they are rotatable in the vertical direction.

Also, in a rear end area of this keyboard chassis 1, a rear leg section 13 which supports the rear end of the keyboard chassis 1 is downwardly provided from an upper portion of the keyboard chassis 1 toward the bottom thereof, as shown in FIG. 1 and FIG. 2. In an area near the lower end of this rear leg section 13, a lower-limit stopper section 14 such as felt for restricting a lower-limit position of each hammer member 3 is provided. Also, on a portion of the undersurface of the key mounting section 11 located on an upper portion of the rear leg section 13, an upper-limit stopper section 15 such as felt for restricting an upper-limit position of each hammer member 3 is provided.

The keys 2 include white keys 2*a* and black keys 2*b* as shown in FIG. 1 to FIG. 2, and a total of 88 white keys 2*a* and black keys 2*b* are arranged in parallel on the keyboard chassis 1. Note that, in this first embodiment, only one white key 2*a* is described as an example. A rear end portion (a left end portion in FIG. 1) of this key 2 serving as a white key 2*a* is supported on the key supporting section 12*a* of the key supporting section 12 on the key mounting section 11 of the keyboard chassis 1 in a manner to be rotatable in the vertical direction.

On a substantially middle portion of the key 2 in the front-rear direction (the left-right direction in FIG. 1), a switch pressing section 16 for pressing one of the switch sections 4 mounted on the board mounting section 9 of the keyboard chassis 1 is provided projecting downward, as shown in FIG. 1 and FIG. 2. In this embodiment, each switch section 4 includes a switch board 17 arranged along the array direction of the keys 2 and a rubber switch 18 arranged on this switch board 17.

A front end portion (a right end portion in FIG. 2) of the switch board 17 is arranged on the hammer placing section 7 and the other end portion (a left end portion in FIG. 1) thereof is arranged on the board supporting section 10 provided on the board mounting section 9, as shown in FIG. 1 and FIG. 2. As a result, the switch board 17 is arranged along the array direction of the keys 2 with it being positioned above the board mounting section 9. The rubber switch 18 has a dome-shaped bulging section 18*a* provided corresponding to the switch pressing section 16 in each of the plurality of keys 2.

Also, each switch section 4 is structured such that, when the bulging section 18*a* of the rubber switch 18 is pressed by the switch pressing section 16, the bulging section 18*a* is elastically deformed and a plurality of movable contact points provided therein respectively come in contact with a plurality of fixed contact points provided on the switch board 17 (both movable and fixed contact points are not shown) so as to output an ON signal, as shown in FIG. 1 and FIG. 2.

Further, on a portion of the key 2 located in front (to the right in FIG. 1) of the switch pressing section 16 of the key 2, a hammer pressing section 20 is provided projecting downward, as shown in FIG. 1 and FIG. 2. On a lower portion of this hammer pressing section 20, a hammer holding section 21 is provided which slidably holds a later-described key contacting and sliding section 25 of the corresponding hammer member 3.

The hammer members 3 each include a hammer arm 22 arranged corresponding to the lower side of the corresponding key 2, a weight section 23 provided on the rear side (the left side in FIG. 3) of the hammer arm 22, an elastic supporting section 24 provided on the front side (the right side in FIG. 3) of the hammer arm 22 and serving as the rotational center of the hammer arm 22, and the key contacting and sliding section 25 provided on a front end portion (a right end portion in FIG. 3) of the hammer arm 22. In addition, the hammer members 3 include the hammer connecting section 26 which is arranged along the array direction of the hammer arms 22 and to which the elastic supporting sections 24 are connected.

In this embodiment, the 88 hammer members 3 are arranged in parallel corresponding to the plurality of keys 2 arranged in parallel. Also, each hammer arm 22 includes a raised section 22*a* provided at the front end portion (the right end portion in FIG. 3), a horizontal section 22*b* provided on a lower portion of the raised section 22*a* and extending toward the rear side (the left side in FIG. 3), an inclined section 22*c* provided on a rear end portion of the horizontal section 22*b* and extending downward and rearward, and a weight mounting section 22*d* provided on a lower portion of the inclined section 22*c* and extending toward the rear side.

Figure 3:
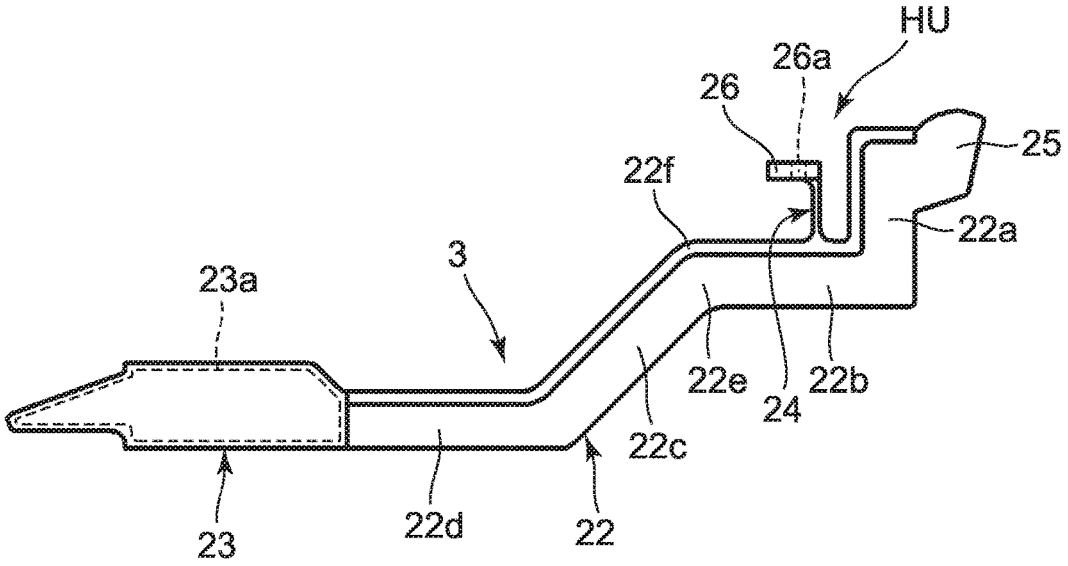
FIG. 3 is an enlarged side view showing a hammer member in the keyboard device shown in FIG. 1.
Figure 4A:
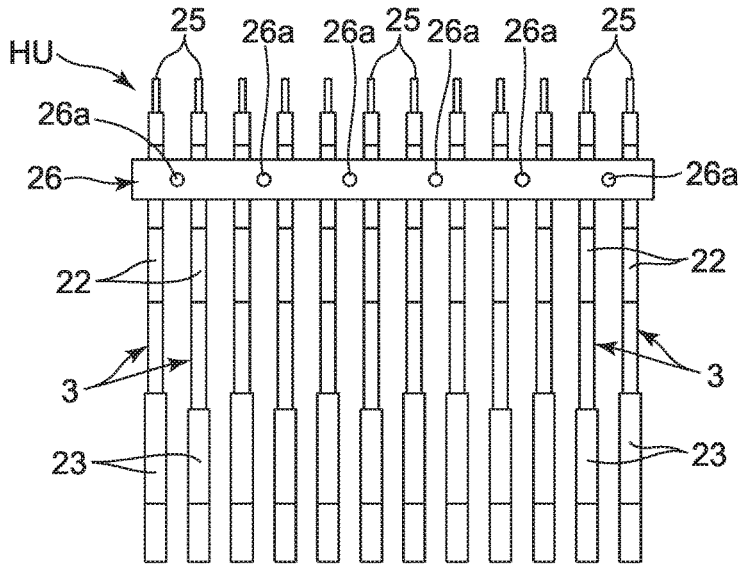
FIG. 4A is a plan view showing a hammer unit in which hammer members shown in FIG. 3 are connected to one another in the array direction of the hammer members.
Figure 4B:
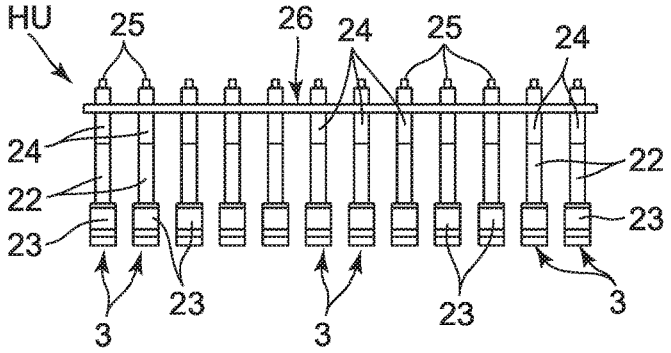
FIG. 4B is a front view showing the hammer unit in which the hammer members shown in FIG. 3 are connected to one another in the array direction.

As shown in FIG. 3 and FIG. 4, the hammer arm 22 excluding the area of the weight section 23 forms, as a whole, a T shape in cross section. That is, except for the area of the weight section 23, the hammer arm 22 has a vertical plate section 22*e* which is long in the front-rear direction and a lateral plate section 22*f* provided on the upper side of the vertical plate section 22*e* and located over the entire length thereof. As a result, the rigidity of the entire hammer arm 22 is ensured.

In the weight section 23, a weight 23*a* made of metal is provided integrally with the hammer arm 22 by insert molding, as shown in FIG. 3. The elastic supporting section 24 is a plate-shaped spring section which is elastically deformable, and provided upright on the horizontal section 22*b* of the hammer arm 22, as shown in FIG. 3 and FIG. 4.

This elastic supporting section 24 is elastically deformed to be bent in the front-rear direction of the hammer arm 22 when the key contacting and sliding section 25 is pressed downward or when the hammer arm 22 is rotationally displaced by the weight of the weight section 23, and thereby supports the hammer arm 22 by a displacement action of rotating the hammer arm 22, or in other words, supports the hammer arm 22 with it being rotationally displaced in the vertical direction, as shown in FIG. 1 to FIG. 3.

More specifically, this elastic supporting section 24 is provided such that its length in the array direction of the hammer arms 22 is equal to the width of the lateral plate section 22*f* on the upper side of the hammer arm 22, i.e., the length of the lateral plate section 22*f* in the array direction of the hammer arms 22, its thickness is smaller than the thickness of the lateral plate section 22*f*, and its height is lower than the height of the raised section 22*a* of the hammer arm 22, as shown in FIG. 3 and FIG. 4.

As a result, the elastic supporting section 24 is structured such that it is elastically deformed to be bent in the front-rear direction of the hammer arm 22, and whereby its middle portion and the vicinity thereof serve as a plate spring-shaped hinge that is a rotational center when the key contacting and sliding section 25 is pressed downward or when the hammer arm 22 is rotationally displaced by the weight of the weight section 23, as shown in FIG. 1 to FIG. 2.

The key contacting and sliding section 25 is provided projecting frontward (rightward in FIG. 3) from an upper portion of the raised section 22*a* of the hammer arm 22, as shown in FIG. 1 and FIG. 4. As a result, the key contacting and sliding section 25 is slidably held while coming in contact with the lower surface of the hammer holding section 21 provided on the hammer pressing section 20 of the key 2, and is moved in the vertical direction and the front-rear direction in response to a key depression operation performed on the key 2.

In this embodiment, the hammer holding section 21 of the key 2 is provided on the lower portion of the hammer pressing section 20 of the key 2 in a manner to project in the array direction of the keys 2, and is slid in the front-rear direction of the key 2 in response to the elastic deformation of the elastic supporting section 24 with the key contacting and sliding section 25 coming in contact with its lower surface from below, as shown in FIG. 1 and FIG. 2. Also, the key contacting and sliding section 25 has an upper end portion formed in a circular arc shape, and slides in the front-rear direction of the key 2 with this upper end portion in a circular arc shape coming in contact with the hammer holding section 21 of the key 2 from below.

The hammer connecting section 26 has a long band plate shape extending along the array direction of the plurality of hammer members 3, and upper end portions of the plurality of elastic supporting sections 24 are integrally provided on the lower surface of the hammer connecting section 26, as shown in FIG. 3 and FIG. 4. That is, this hammer connecting section 26 connects the plurality of hammer arms 22 to one another by the plurality of elastic supporting sections 24 being connected thereto with the plurality of hammer members 3 being arranged in parallel along the array direction of the keys 2, and thereby unitizes the hammer members 3. As a result, one hammer unit HU is assembled.

Figure 4C:
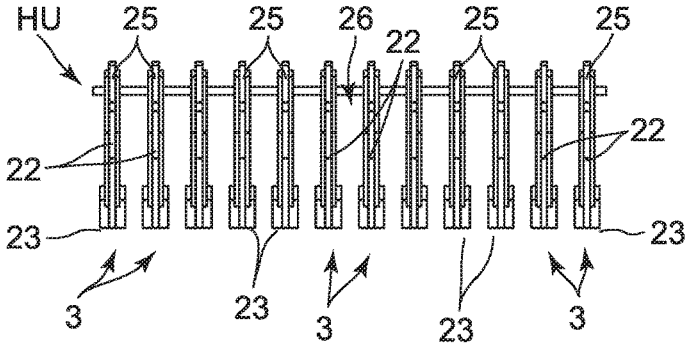
FIG. 4C is a rear view showing the hammer unit in which the hammer members shown in FIG. 3 are connected to one another in the array direction.

Each hammer unit HU is mounted in the keyboard chassis 1 by the hammer connecting section 26 being mounted on the plurality of hammer mounting sections 8 on the undersurface of the hammer placing section 7 of the keyboard chassis 1 with the plurality of hammer members 3 being arranged in parallel and the plurality of hammer arms 22 being connected to one another by the hammer connecting section 26, as shown in FIGS. 4A and 4C.

In this hammer unit HU, for example, a plurality of hammer members 3 for keys 2 corresponding to one octave are arranged in parallel and, in this state, the elastic supporting sections 24 on the plurality of hammer arms 22 are integrally provided on the hammer connecting section 26, as shown in FIG. 1 to FIG. 4. As a result, in the hammer unit HU, the hammer arms 22 corresponding to one octave are connected to one another by the hammer connecting section 26 with them being arranged in parallel.

Also, this hammer unit HU is mounted in the keyboard chassis 1 by predetermined portions of the hammer connecting section 26 being attached to the plurality of hammer mounting sections 8 on the keyboard chassis 1 with screws 27, as shown in FIG. 4A. In this embodiment, the hammer connecting section 26 has mounting holes 26*a* provided in plural areas, and the screws 27 are inserted into these mounting holes 26*a*. More specifically, the mounting holes 26*a* are provided in plural areas whose number is smaller than the number of the arrayed hammer arms 22. For example, they are provided every two hammer arms 22, and each of which is positioned between hammer arms 22.

Accordingly, the plurality of hammer mounting sections 8 shown in FIG. 1 and FIG. 2 are provided corresponding to the plurality of mounting holes 26*a* in the hammer connecting section 26, on the undersurface of the hammer placing section 7 of the keyboard chassis 1. As a result, the hammer unit HU is structured such that the plurality of screws 27 are inserted into the mounting holes 26*a* and screwed into the screw holes of the plurality of hammer mounting sections 8 on the hammer placing section 7 with the hammer connecting section 26 being arranged on the undersurfaces of the hammer mounting sections 8, whereby the plurality of hammer members 3 corresponding to, for example, one octave are mounted at one time.

In this hammer unit HU, except for the weights 23*a* of the weight sections 23 of the hammer members 3, the plurality of hammer arms 22, the plurality of weight sections 23, the plurality of elastic supporting sections 24, the plurality of key contacting and sliding sections 25, and the hammer connecting section 26 are all integrally formed of synthetic resin such as polyacetal (POM), polypropylene (PP), and ABS (Acrylonitrile Butadiene Styrene) resin, and unitized, as shown in FIG. 3 and FIG. 4.

The plurality of hammer members 3 in this hammer unit HU are structured such that, by the hammer connecting section 26 being mounted on the plurality of hammer mounting sections 8 on the undersurface of the hammer placing section 7 with each key contacting and sliding section 25 of the plurality of hammer arms 22 being inserted into an opening section 19*a* provided in a front lowered section 19 in the hammer placing section 7 of the keyboard chassis 1, the plurality of hammer arms 22 are supported with them being rotationally displaceable in the vertical direction around the plurality of elastic supporting sections 24, as shown in FIG. 1 and FIG. 2.

Also, the plurality of hammer members 3 in this hammer unit HU are structured such that, when the hammer connecting section 26 is mounted on the plurality of hammer mounting sections 8 provided on the undersurface of the hammer placing section 7, the plurality of key contacting and sliding sections 25 provided on the front end portions (the right end portions in FIG. 1) of the plurality of hammer arms 22 are slidably arranged with their upper end portions in a circular arc shape coming in contact with the plurality of hammer holding sections 21 on the hammer pressing sections 20 of the plurality of keys 2 from below, as shown in FIG. 1 and FIG. 2.

As a result, the plurality of hammer members 3 in the hammer unit HU are structured such that, in a normal state, the plurality of hammer arms 22 are rotationally displaced around the plurality of elastic supporting sections 24 in the counterclockwise direction by the weights of the plurality of weight sections 23, the rear ends (the left ends in FIG. 1) of the plurality of hammer arms 22 on the weight section 23 side are positionally restricted by coming in contact with the lower-limit stopper section 14, and the key contacting and sliding sections 25 on the plurality of hammer arms 22 press up the hammer pressing sections 20 of the plurality of keys 2 so as to positionally restrict the plurality of keys 2 to their upper-limit positions, as shown in FIG. 1.

Also, the plurality of hammer members 3 in this hammer unit HU are structured such that, when the plurality of keys 3 are depressed from above and the key contacting and sliding sections 25 on the plurality of hammer arms 22 are pressed downward against the weights of the weight sections 23 on the plurality of hammer arms 22 by the hammer pressing sections 20 of the plurality of keys 2, the plurality of elastic supporting sections 24 are elastically deformed to be bent, and the plurality of hammer arms 22 are rotationally displaced around the plurality of elastic supporting sections 24 in the clockwise direction, as shown in FIG. 2.

Further, the plurality of hammer members 3 in this hammer unit HU are structured such that, when the plurality of hammer arms 22 are rotationally displaced around the plurality of elastic supporting sections 24 in the clockwise direction against the weights of the weight sections 23 on the plurality of hammer arms 22, the rear ends of the plurality of hammer arms 22 on the weight section 23 side come in contact with the upper-limit stopper 15 provided on the undersurface of the key mounting section 11 of the keyboard chassis 1 and the rotational displacement of each hammer arm 22 in the clockwise direction is stopped, as shown in FIG. 2.

Next, the mechanism of this keyboard device 1 is described.

First, in an initial state where the key 2 has not been depressed, when the elastic supporting section 24 of the hammer arm 22 is elastically deformed by the weight of the weight section 23 of the hammer member 3, the hammer arm 22 is rotationally displaced around the elastic supporting section 24 in the counterclockwise direction, and the rear end of the hammer member 3 on the weight section 23 side comes in contact with the lower-limit stopper 15 provided near the lower end of the rear leg section 13 of the keyboard chassis 1, as shown in FIG. 1.

Here, the hammer holding section 21 on the hammer pressing section 20 of the key 2 is pressed upward by the key contacting and sliding section 25 on the front end (the right end in FIG. 1) of the hammer arm 22, as shown in FIG. 1. Accordingly, the key 2 is rotated around the key supporting shaft 12*a* of the key supporting section 12 on the keyboard mounting section 11 of the keyboard chassis 1 in the counterclockwise direction, and then restricted at its upper-limit position.

Also, the switch pressing section 16 on the key 2 is moved upward to be away from the bulging section 18*a* of the switch section 4. Accordingly, the switch section 4 enters a free state where the bulging section 18*a* has bulged, and the plurality of movable contacts are moved away from a plurality of fixed contacts (both the movable and fixed contacts are not shown). As a result, the switch section 4 enters an OFF state.

In this state, when the key 2 is depressed, the key 2 is rotated around the key supporting shaft 12*a* of the key supporting section 12 in the clockwise direction, and the hammer holding section 21 on the hammer pressing section 20 presses the key contacting and sliding section 25 of the hammer member 3 downward, as shown in FIG. 2. As a result, the elastic supporting section 24 on the hammer arm 22 is elastically deformed to be bent, and the hammer member 3 is rotationally displaced around this elastic supporting section 24 in the clockwise direction in FIG. 2 against the weight of the weight section 23. By this rotational displacement of the hammer arm 22 of the hammer member 3, an action load is applied to the key 2.

Here, the switch pressing section 16 on the key 2 presses the bulging section 18*a* of the rubber switch 18 of the switch section 4. Accordingly, the bulging section 18*a* of the rubber switch 18 is elastically deformed, and the plurality of movable contacts sequentially come in contact with the plurality of fixed contacts (both the movable and fixed contacts are not shown) at time intervals. As a result, the switch section 4 outputs a switch signal.

When the key 2 is further rotated and the hammer member 3 is further rotationally displaced, the rear end (the left end in FIG. 2) of the hammer member 3 comes in contact with the upper-limit stopper 15 provided on the undersurface of the key mounting section 11 of the keyboard chassis 1, the hammer arm 22 is restricted at its upper-limit position, and the rotational displacement of the hammer member 3 is stopped. As such, when the hammer member 3 is rotationally displaced, a key-touch feel close to that of an acoustic piano can be acquired.

Then, when a finger on the key 2 is released therefrom and the key 2 starts a key releasing movement, the hammer arm 22 of the hammer member 3 starts to be rotationally displaced around the elastic supporting section 24 on the hammer arm 22 in the counterclockwise direction by the weight of the weight section 23, an elastic return force of the elastic supporting section 24 of the hammer member 3, and an elastic return force of the bulging section 18*a* of the rubber switch 18 of the switch section 4, as shown in FIG. 2.

Here, by the elastic supporting section 24 on the hammer arm 22 being elastically deformed by the weight of the weight section 23 on the hammer arm 22, the hammer arm 22 is further rotationally displaced around the elastic supporting section 24 in the counterclockwise direction. Then, the hammer holding section 21 on the hammer pressing section 20 is pressed upward by the key contacting and sliding section 25 on the front end (the right end in FIG. 2) of the hammer arm 22.

As a result, the key 2 is rotated around the key supporting shaft 12*a* of the key supporting section 12 in the counterclockwise direction, and then restricted at its upper-limit position, as shown in FIG. 1. Also, here, the rear end of the hammer arm 22 on the weight section 23 side comes in contact with the lower-limit stopper 15 provided near the lower end of the rear leg section 13 of the keyboard chassis 1. Accordingly, the key 2 is returned to its initial position, the switch pressing section 16 on the key 2 is moved upward to be away from the switch section 4, and the switch section 4 enters an OFF state.

As described above, the hammer unit HU in this keyboard device includes the plurality of hammer members 3 including the plurality of hammer arms 22 which are operated in response to key depression operations on the plurality of keys 2 and the plurality of elastic supporting sections 24 which are provided on the plurality of hammer arms 22 and connected to the hammer connecting section 26. As a result, by the plurality of hammer members 3 being unitized, the assembling workability of the hammer members 3 is improved.

In the hammer unit HU of this embodiment, the plurality of elastic supporting sections 24 are provided on the plurality of hammer arms 22 in a manner to be elastically deformable. By the plurality of hammer arms 22 being displaced, the plurality of hammer arms 22 are rotationally displaced in response to key depression operations on the plurality of keys 2.

That is, each elastic supporting section 24 is elastically deformed and bent in the front-rear direction of the corresponding hammer arm 22 so as to support the hammer arm 22 by a displacement action of rotating the hammer arm 22, or in other words, so as to rotationally displace the hammer arm 22 in the vertical direction. As a result, the hammer arm 22 can be favorably rotationally displaced to be rotated in the vertical direction in response to a key depression operation on the corresponding key 2.

Also, in this hammer unit HU, the hammer connecting section 26 is arranged along the array direction of the plurality of hammer arms 22 and connects the plurality of hammer arms 22 to one another with them being arrayed. As a result of this structure, the plurality of hammer arms 22 can be connected to one another with them being arrayed in the array direction by the hammer connecting section 26, so that the plurality of hammer members 3 can be unitized and assembled into the keyboard chassis 1 at one time.

That is, in this hammer unit HU, the hammer arms 22 corresponding to, for example, one octave can be connected to one another with them being arrayed by the hammer connecting section 26. As a result of this structure, the hammer members 3 corresponding to one octave can be unitized and assembled at one time, which significantly improves the assembling workability and the productivity.

Also, in this hammer unit HU, except for the weights 23*a* of the weight sections 23 of the hammer members 3, the plurality of hammer arms 22, the plurality of weight sections 23, the plurality of elastic supporting sections 24, the plurality of key contacting and sliding sections 25, and the hammer connecting section 26 are all integrally formed of synthetic resin such as polyacetal (POM), polypropylene (PP), and ABS resin, whereby the number of components can be significantly reduced. In addition, since the hammer members 3 need not be individually manufactured, the productivity can be significantly improved.

Also, the hammer connecting section 26 in this hammer unit HU is mounted on the keyboard chassis 1 by the plurality of predetermined areas whose number is smaller than the number of the arrayed hammer arms 22 being attached thereto by a plurality of screws 27 each serving as a mounting member. As a result of this structure, the number of areas of the hammer connecting section 26 to be mounted by the plurality of screws 27 can be made smaller than the number of the arrayed hammer arms 22. Accordingly, the mounting of the hammer connecting section 26 on the keyboard chassis 1 can be simplified. As a result, the hammer connecting section 26 can be efficiently mounted on the keyboard chassis 1.

In this case, in the hammer connecting section 26, the mounting holes 26*a* into which the screws 27 are inserted can be provided, for example, every two arranged hammer arms 22. Accordingly, the mounting of the hammer connecting section 26 on the keyboard chassis 1 can be further simplified. As a result, the hammer connecting section 26 can be efficiently mounted on the keyboard chassis 1.

Further, in this hammer unit HU, the elastic supporting sections 24 of the plurality of hammer members 3 are provided projecting upward on the plurality of hammer arms 22, whereby upper and portions of the plurality of elastic supporting sections 24 can be connected to the hammer connecting section 26. Also, the hammer connecting section 26 is arranged above the plurality of hammer arms 22, and therefore can be easily and reliably mounted on the plurality of hammer mounting sections 8 provided on the undersurface of the hammer placing section 7 of the keyboard chassis 1.

Second Embodiment

Next, a second embodiment of a keyboard device in which the present invention has been applied is described with reference to FIG. 5. Note that sections that are the same as those of the first embodiment shown in FIG. 1 to FIG. 4 are provided with the same reference numerals.

Figure 5:
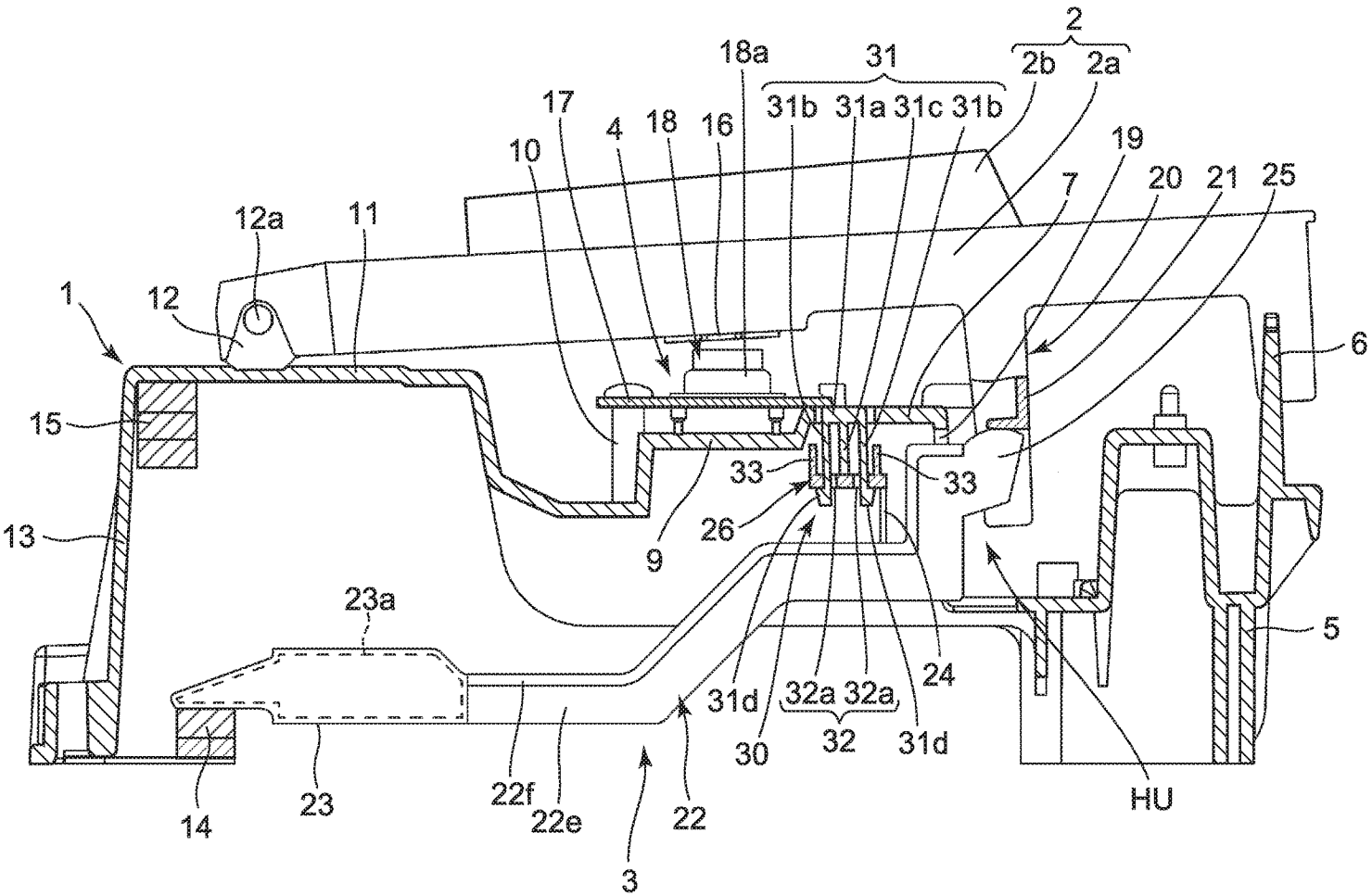
FIG. 5 is a cross-sectional view showing a second embodiment of a keyboard device in which the present invention has been applied.

This keyboard device has substantially the same structure as that of the first embodiment except that mounting members 30 are included which mount, on the keyboard chassis 1, the hammer connecting section 26 in the hammer unit HU, as shown in FIG. 5.

More specifically, each mounting member 30 includes an engagement hook 31 provided on the undersurface of the hammer placing section 7 of the keyboard chassis 1 and a locking section 32 provided in the hammer connecting section 26 so as to lock the engagement hook 31. The locking section 32 has a pair of locking holes 32*a* provided penetrating in the vertical direction in both side portions of the hammer connecting section 26 in the front-rear direction of the corresponding hammer arm 22.

The engagement hook 31 includes a fixing section 31*a* mounted on the undersurface of the hammer placing section 7, a pair of hook pieces 31*b* downwardly provided with them opposing each other on both side portions of the fixing section 31*a* in the front-rear direction of the hammer arm 22, and a pressing piece 31*c* downwardly provided on a middle portion of the fixing section 31*a* between the pair of hook pieces 31*b*, as shown in FIG. 5.

This engagement hook 31 is structured such that, when the pair of hook pieces 31*b* is inserted into the pair of locking holes 32*a* of the locking section 32 provided in the hammer connecting section 26 from above the hammer connecting section 26 and the pressing piece 31*c* comes in contact with the upper surface of the hammer connecting section 26, the hammer connecting section 26 is pinched by each contacting section 31*d* of the pair of hook pieces 31*b* and the pressing piece 31*c* in its thickness direction (the vertical direction in FIG. 5) and held therebetween by the contacting sections 31*d* of the pair of hook pieces 31*b* being pressed against the undersurface of the hammer connecting section 26, as shown in FIG. 5.

In this embodiment, as shown in FIG. 5, a pair of reinforcement ribs 33 is provided along the array direction of hammer arms 22, on both side portions of the hammer connecting section 26 in the front-rear direction of the hammer arm 22. The pair of reinforcement ribs 33 enhances the strength of the hammer connecting section 26 and prevents the hammer connecting section 26 from bending and twisting in the array direction of the hammer arms 22.

In this embodiment as well, in the hammer unit HU, the elastic supporting sections 24 on the hammer arms 22 are integrally provided on the hammer connecting section 26 with the plurality of hammer members 3 for keys 2 corresponding to, for example, one octave being arranged in parallel as in the case of the first embodiment. As a result, in the hammer unit HU, the plurality of hammer members 3 are integrally connected with them being arranged along the array direction of the keys 2.

Also, the locking sections 32 of the mounting members 30 are provided in a plurality of areas whose number is smaller than the number of the arrayed hammer arms 22. For example, as in the case of the first embodiment, they are provided every two hammer arms 22 and each of which is positioned between hammer arms 22, in the hammer connecting section 26. Accordingly, the engagement hooks 31 of the mounting members 30 are provided corresponding to the plurality of locking sections 32, on the undersurface of the hammer placing section 7.

The hammer unit HU in this keyboard device enables the hammer connecting section 26 to be simply and easily mounted on the hammer placing section 7 by the mounting members 30, which mount the hammer connecting section 26 on the keyboard chassis 1, including the plurality of engagement hooks 31 provided on the keyboard chassis 1 and the plurality of locking sections 32 provided in the hammer connecting section 26 so as to lock the plurality of engagement hooks 31, in addition to having the same function and effect as that of the first embodiment.

That is, in the hammer unit HU in this keyboard device, when the hammer connecting section 26 is to be assembled into the keyboard chassis 1, the hammer connecting section 26 where the plurality of hammer members 3 have been connected to one another with them being arranged in parallel can be simply and easily mounted on the hammer placing section 7 by the plurality of engagement hooks 31 on the hammer placing section 7 being inserted into the corresponding locking sections 32 in the hammer connecting section 26 with the hammer connecting section 26 being arranged on the undersurface of the hammer placing section 7 of the keyboard chassis 1.

In this embodiment, each engagement hook 31 includes the fixing section 31*a* mounted on the undersurface of the hammer placing section 7, the pair of hook pieces 31*b* downwardly provided with them opposing each other on both side portions of the fixing section 31*a* in the front-rear direction of the corresponding hammer arm 22, and the pressing piece 31*c* downwardly provided on the middle portion of the fixing section 31*a* between the pair of hook pieces 31*b*, and each locking section 32 includes the pair of locking holes 32*a* provided penetrating in the vertical direction in both side portions of the hammer connecting section 26 in the front-rear direction of the hammer arm 22. As a result of this structure, the hammer connecting section 26 can be simply mounted on the hammer placing section 7 by the engagement hooks 31 being merely inserted into the locking sections 32.

That is, in each mounting member 30, when the pair of hook pieces 31*b* of the engagement hook 31 is inserted into the pair of locking holes 32*a* of the locking section 32 in the hammer connecting section 26 from above the hammer connecting section 26, and the pressing piece 31*c* is brought into contact with the upper surface of the hammer connecting section 26, the contacting sections 31*d* of the pair of hook pieces 31*b* are pressed against the undersurface of the hammer connecting section 26. As a result, the hammer connecting section 26 can be reliably held with it being pinched in its thickness direction by each contacting section 31*d* of the pair of hook pieces 31*b* and the pressing piece 31*c*.

Also, in this hammer unit HU, the pair of reinforcement ribs 33 is provided along the array direction of the hammer arms 22, on both side portions of the hammer connecting section 26 in the front-rear direction of the hammer arm 22. These reinforcement ribs 33 enhance the strength of the hammer connecting section 26. As a result, the hammer connecting section 26 can be reliably and favorably prevented from bending and twisting in the array direction of the hammer arms 3.

In the above-described second embodiment, the hammer placing section 7 of the keyboard chassis 1 is provided with the engagement hooks 31, and the hammer connecting section 26 is provided with the locking sections 32. However, the present invention is not limited thereto. For example, the keyboard device may be structured such that the hammer placing section 7 of the keyboard chassis 1 is provided with the locking sections 32 and the hammer connecting section 26 is provided with the engagement hooks 31.

Third Embodiment

Next, a third embodiment of a keyboard device in which the present invention has been applied is described with reference to FIG. 6 and FIG. 7. In this embodiment as well, sections that are the same as those of the first embodiment shown in FIG. 1 to FIG. 4 are provided with the same reference numerals.

Figure 6:
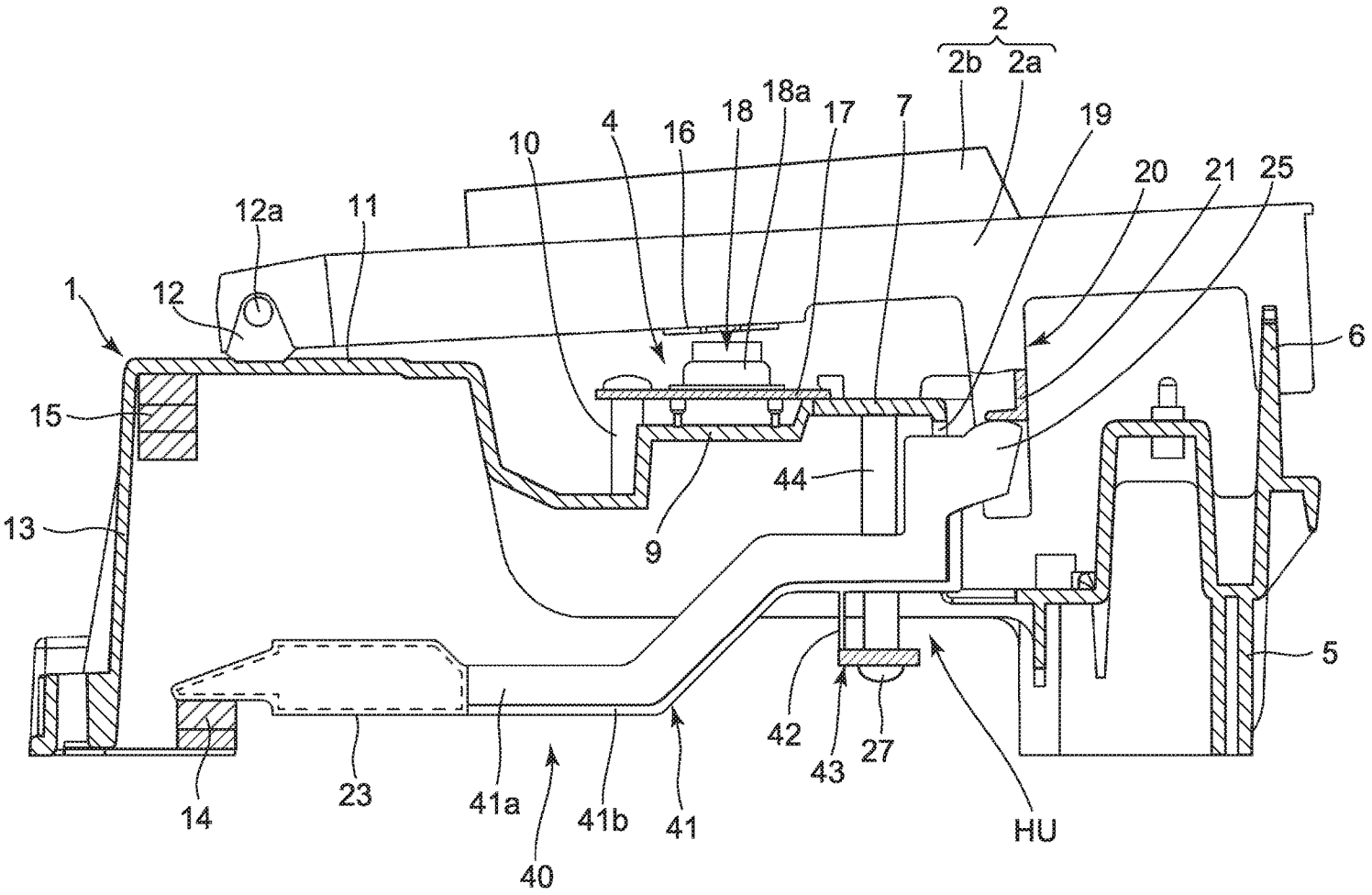
FIG. 6 is a cross-sectional view showing a third embodiment of a keyboard device in which the present invention has been applied.
Figure 7:
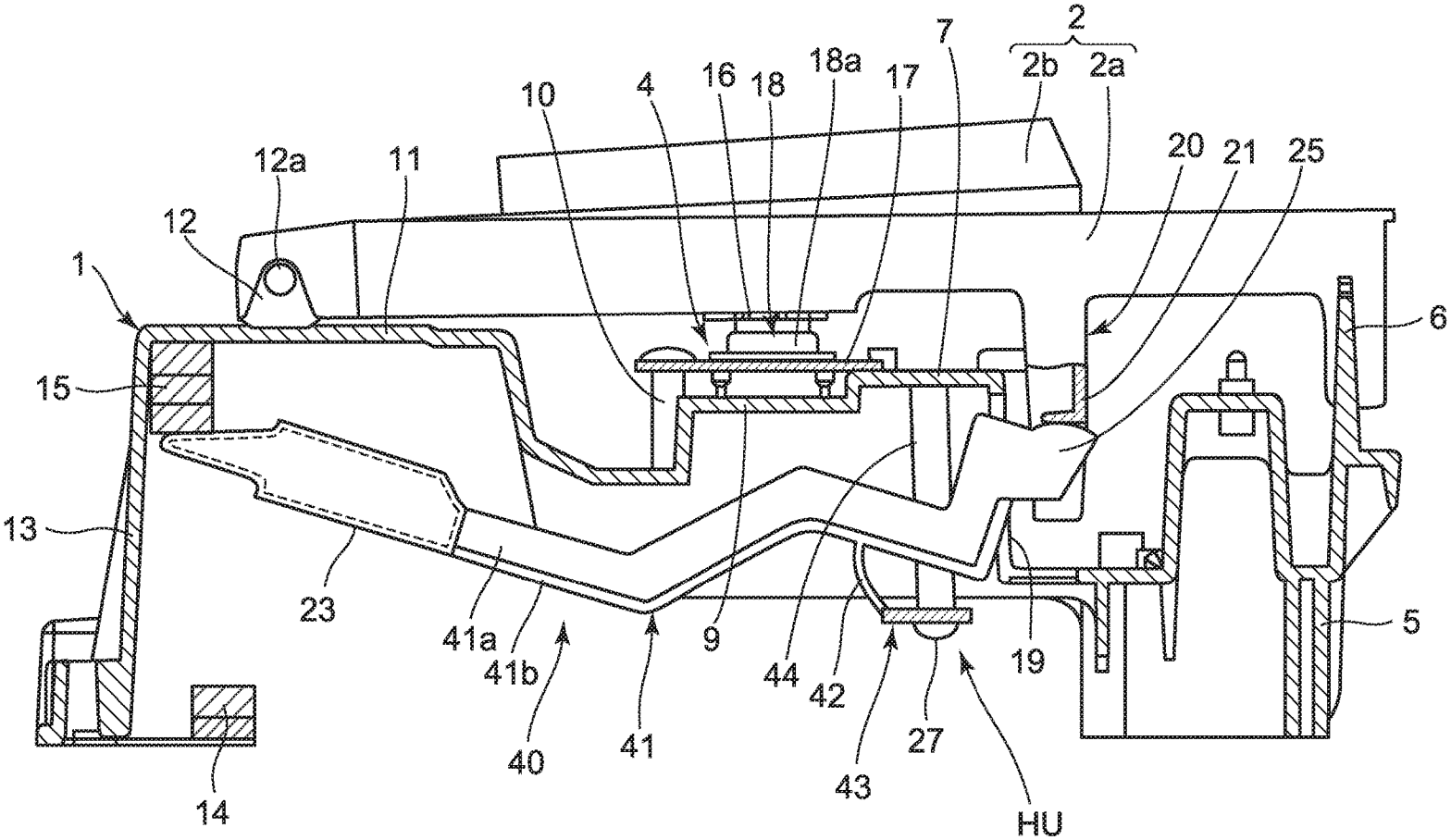
FIG. 7 is a cross-sectional view showing a state where a key has been depressed in the keyboard device shown in FIG. 6.

This keyboard device has substantially the same structure as that of the first embodiment except that its hammer members 40 in the hammer unit HU have a structure different from that in the first embodiment, as shown in FIG. 6 and FIG. 7.

Hammer arms 41 of these hammer members 40 differ in cross-sectional shape from the hammer members 22 of the first embodiment, as shown in FIG. 6 and FIG. 7. That is, except for the area of the weight section 23, each hammer arm 41 has a vertical plate section 41*a* which is long in the front-rear direction, and a lateral plate section 41*b* provided on the lower side of the vertical plate section 41*a* over the entire length of the vertical plate section 41*a*. As a result, the hammer arm 41 has an inverted T cross-sectional shape, and the entire rigidity thereof is ensured.

Also, an elastic supporting section 42 of each hammer member 40 is provided projecting downward on the undersurface of the corresponding lateral plate section 41*b* and positioned on the front side (the right side in FIG. 6) of the corresponding hammer arm 41, as shown in FIG. 6 and FIG. 7. This elastic supporting section 42 is a plate-shaped spring section which is elastically deformable, as in the case of the first embodiment.

This elastic supporting section 42 is elastically deformed to be bent in the front-rear direction of the hammer arm 41 when the key contacting and sliding section 25 is pressed downward or when the hammer arm 41 is rotationally displaced by the weight of the weight section 23, and thereby supports the hammer arm 41 by a displacement action of rotating the hammer arm 41, or in other words, supports the hammer arm 22 with it being rotationally displaced in the vertical direction as shown in FIG. 6 and FIG. 7, as in the case of the first embodiment.

That is, this elastic supporting section 42 is provided such that its length in the array direction of the hammer arms 41 is equal to the width of the lateral plate section 41*b* positioned on the underside of the hammer arm 41, i.e., the length of the lateral plate section 41*b* in the array direction of the hammer arms 41, its thickness is smaller than the thickness of the lateral plate section 41*b*, and its height is substantially equal to that of the elastic supporting section 24 in the first embodiment, as shown in FIG. 6 and FIG. 7.

As a result, as in the case of the first embodiment, the elastic supporting section 42 is structured such that it is elastically deformed to be bent in the front-rear direction of the hammer arm 22, and whereby its middle portion and the vicinity thereof serve as a plate spring-shaped hinge that is a rotational center when the key contacting and sliding section 25 is pressed downward or when the hammer arm 41 is rotationally displaced by the weight of the weight section 23, as shown in FIG. 6 to FIG. 7.

Also, the hammer members 40 include a hammer connecting section 43 which connects the plurality of hammer arms 41 to one another in the array direction of the hammer arms 41, as shown in FIG. 6 and FIG. 7. This hammer connecting section 43 has a long band plate shape extending along the array direction of the plurality of hammer arms 41, and lower end portions of the plurality of elastic supporting sections 42 are integrally provided on the upper surface of the hammer connecting section 43, as in the case of the first embodiment.

That is, this hammer connecting section 43 connects the plurality of hammer arms 41 to one another by the plurality of elastic supporting sections 42 being connected thereto with the plurality of hammer members 40 being arranged in parallel along the array direction of the keys 2, and thereby unitizes the hammer members 40, as shown in FIG. 6 and FIG. 7. As a result, the hammer unit HU is assembled.

In this hammer unit HU, the hammer connecting section 43 is mounted on lower end portions of a plurality of hammer mounting sections 44 provided on the undersurface of the hammer placing section 7 of the keyboard chassis 1, as shown in FIGS. 6 and 7. In this embodiment, the hammer mounting sections 44 are provided protruding downward through the hammer arms 41 from the undersurface of the hammer placing section 7 of the keyboard chassis 1. As a result, the hammer connecting section 43 is arranged below the plurality of hammer arms 41.

Also, in this hammer unit HU, the elastic supporting sections 42 on the plurality of hammer arms 41 are provided integrally with the hammer connecting section 43 with the plurality of hammer members 40 for keys 2 corresponding to, for example, one octave being arranged in parallel, as shown in FIG. 6 and FIG. 7. As a result, in the hammer unit HU, the hammer members 40 corresponding to one octave are unitized by being connected to one another by the hammer connecting section 43 with them being arranged in parallel.

Further, in this hammer unit HU, predetermined portions of the hammer connecting section 43 are attached to the lower ends of the hammer mounting sections 44 on the keyboard chassis 1 by the screws 27, as in the case of the first embodiment. In this embodiment, the hammer connecting section 43 has mounting holes (not shown) provided in plural areas, and the screws 27 are inserted thereinto. More specifically, the mounting holes are provided in plural areas whose number is smaller than the number of the arrayed hammer arms 41. For example, they are provided every two hammer arms 41, and each of which is positioned between hammer arms 41, as in the case of the first embodiment.

Accordingly, as with the first embodiment, the plurality of hammer mounting sections 44 are provided corresponding to the plurality of mounting holes (not shown) in the hammer connecting section 43, on the undersurface of the hammer placing section 7 of the keyboard chassis 1. As a result, the hammer unit HU is structured such that the plurality of screws 27 are inserted into the mounting holes of the hammer connecting sections 43 and screwed into the screw holes of the plurality of hammer mounting sections 44 on the hammer placing section 7 with the hammer connecting section 43 being arranged on the undersurfaces of the hammer mounting sections 44, whereby the plurality of hammer members 40 corresponding to, for example, one octave are mounted at one time.

In this hammer unit HU, except for the weights of the weight sections 23 of the hammer members 40, the plurality of hammer arms 41, the plurality of weight sections 23, the plurality of elastic supporting sections 42, the plurality of key contacting and sliding sections 25, and the hammer connecting section 43 are all integrally formed of synthetic resin such as polyacetal (POM), polypropylene (PP), and ABS resin, and unitized, as in the case of the first embodiment.

The plurality of hammer members 40 in this hammer unit HU are structured such that, when the hammer connecting section 43 is mounted on the plurality of hammer mounting sections 44 provided on the undersurface of the hammer placing section 7, the plurality of key contacting and sliding sections 25 provided on front end portions (right end portions in FIG. 6) of the plurality of hammer arms 41 are slidably arranged with their upper end portions in a circular arc shape coming in contact with the plurality of hammer holding sections 21 on the hammer pressing sections 20 of the plurality of keys 2 from below, as shown in FIG. 6 and FIG. 7.

As a result, the plurality of hammer members 40 in the hammer unit HU are structured such that, in a normal state, the plurality of hammer arms 41 are rotationally displaced around the plurality of elastic supporting sections 42 in the counterclockwise direction by the weights of the plurality of weight sections 23, the rear ends (the left ends in FIG. 6) of the plurality of hammer arms 41 on the weight sections 23 side are positionally restricted by coming in contact with the lower-limit stopper section 14, and the key contacting and sliding sections 25 on the plurality of hammer arms 41 press up the hammer pressing sections 20 of the plurality of keys 2 so as to positionally restrict the plurality of keys 2 to their upper-limit positions, as shown in FIG. 6.

Also, the plurality of hammer members 40 in this hammer unit HU are structured such that, when the plurality of keys 2 are depressed from above and the key contacting and sliding sections 25 on the plurality of hammer arms 41 are pressed downward against the weights of the weight sections 23 on the plurality of hammer arms 41 by the hammer pressing sections 20 of the plurality of keys 2, the plurality of elastic supporting sections 42 are elastically deformed to be bent, and the plurality of hammer arms 41 are rotationally displaced around the plurality of elastic supporting sections 42 in the clockwise direction, as shown in FIG. 7.

Further, the plurality of hammer members 40 in this hammer unit HU are structured such that, when the plurality of hammer arms 41 are rotationally displaced around the plurality of elastic supporting sections 42 in the clockwise direction against the weights of the weight sections 23 on the plurality of hammer arms 41, the rear ends of the plurality of hammer arms 41 on the weight section 23 side come in contact with the upper-limit stopper 15 provided on the undersurface of the key mounting section 11 of the keyboard chassis 1 and the rotational displacement of each hammer arm 41 in the clockwise direction is stopped, as shown in FIG. 7.

With the hammer unit HU in this keyboard device, the same function and effect as that of the first embodiment can be achieved. In addition, by the plurality of elastic supporting sections 42 being provided projecting downward on the plurality of hammer arms 41, the lower ends of the plurality of elastic supporting sections 42 can be connected to the hammer connecting section 43. Also, by the hammer connecting sections 43 being arranged below the plurality of hammer arms 41, the hammer connecting section 43 can be easily and reliably mounted on the plurality of hammer mounting section 44 provided on the undersurface of the hammer placing section 7 of the keyboard chassis 1, as with the first embodiment.

In the hammer unit HU in the above-described first or third embodiment, the hammer connecting section 26 or 43 has a long band plate shape extending along the array direction of the hammer arms 22 or 41. However, the present invention is not limited thereto, and a structure may be adopted in which reinforcement ribs similar to the reinforcement ribs 33 of the second embodiment are provided on both side portions of the hammer connecting section 26 or 43 in the front-rear direction along the array direction of the hammer arms 22 or 41.

Also, in the hammer unit HU in the above-described first or third embodiment, the hammer connecting section 26 or 43 connects hammer arms 22 or 41 corresponding to one octave. However, the present invention is not limited thereto, and a structure may be adopted in which hammer arms 22 or 41 corresponding to two octaves are connected to one another or about 10 hammer arms 22 or 41 are connected to one another.

Moreover, in the hammer unit HU in the above-described first or third embodiment, plural portions of the hammer connecting section 26 or 43 are mounted on the hammer placing section 7 of the keyboard chassis 1. These portions are located every two hammer arms 22 or 41. However, the present invention is not limited thereto, and a structure may be adopted in which portions of the hammer connecting section 26 or 43 located every other hammer arm 22 or 41, portions of the hammer connecting section 26 or 43 located every three hammer arms 22 or 41, or three portions of the hammer connecting section 26 or 43 on its end portions and middle portion are mounted.

Furthermore, in the hammer unit HU in the above-described first or third embodiment, the weight 23*a* of each weight section 23 is integrally molded with the corresponding hammer arm 22 or 41 by insert molding. However, the present invention is not limited thereto. For example, the weight 23*a* may be provided integrally with the hammer arms 22 or 41 by caulking processing or bonding. In a case where each hammer arm 22 or 41 is formed of synthetic resin with a high specific gravity so as to have a large wall thickness, the weights 23*a* are not necessarily required to be provided.

Still further, devices for acquiring the above-described various effects are not necessarily required to be structured as described above, and may be structured as follows.

Structural Example 1

A hammer unit including:

a plurality of hammer arms which are respectively operated in response to key depression operations on a plurality of keys; and a hammer connecting section which (i) has a length corresponding to array of the plurality of keys, (ii) is connected to the plurality of hammer arms to support the plurality of hammer arms in an arrayed state, and (iii) has mounting sections which are provided in a direction of the array in areas where the hammer arms are not connected, and by which the hammer connecting section is mounted to a keyboard chassis.

Structural Example 2

The structure of Structural Example 1, in which each mounting section of the hammer connecting section is provided between two areas which are located in the direction of the array and to which two adjacent hammer arms are respectively connected.

Structural Example 3

The structure of Structural Example 1, in which each hammer arm includes a contacting section with which a key comes in contact in response to a key depression operation, a weight section which is moved in response to the key depression operation, and a supporting section which projects in a direction corresponding to an operation direction of the hammer arm, in which the hammer connecting section is connected to respective supporting sections for the plurality of keys, and thereby supports the plurality of hammer arms with each hammer arm being spaced apart from an adjacent hammer arm, and in which the mounting sections of the hammer connecting section are provided in a plurality of areas which are located in the direction of the array and in which the supporting sections are not provided.

Structural Example 4

The structure of Structural Example 3, in which the supporting section is provided to be positioned between the contacting section and the weight section of the hammer arm.

Structural Example 5

The structure of Structural Example 4, in which the hammer arm is rotated in response to the key depression operation such that the contacting section is moved downward and the weight section is moved upward with the supporting section as a center.

Structural Example 6

The structure of Structural Example 3, in which the plurality of supporting sections are provided on the plurality of hammer arms in a manner to be elastically deformable, and displace the plurality of hammer arms.

Structural Example 7

The structure of Structural Example 1, in which the plurality of hammer arms, the plurality of supporting sections, and the hammer connecting section are integrally formed of synthetic resin.

Structural Example 8

The structure of Structural Example 1, in which the mounting sections are provided on a plurality of predetermined portions of the hammer connecting section whose number is smaller than number of the plurality of arrayed hammer arms, and the mounting sections are mounted on the keyboard chassis by mounting members.

Structural Example 9

The structure of Structural Example 8, in which the mounting sections are screw holes, and the mounting members are screws.

Structural Example 10

The structure of Structural Example 8, in which the mounting sections are engagement hooks and the mounting members are locking sections which lock the engagement hooks, or the mounting members are engagement hooks and the mounting sections are locking sections which lock the engagement hooks.

Structural Example 11

The structure of Structural Example 3, in which the supporting section projects in a direction in which the hammer arm is operated.

Structural Example 12

The structure of Structural Example 11, in which the plurality of supporting sections are provided projecting upward on the plurality of hammer arms, and the hammer connecting section is arranged above the plurality of hammer arms.

Structural Example 13

The structure of Structural Example 11, in which the plurality of supporting sections are provided projecting downward on the plurality of hammer arms, and the hammer connecting section is arranged below the plurality of hammer arms.

Structural Example 14

The structure of Structural Example 1, in which the hammer connecting section includes reinforcement sections which inhibit the plurality of hammer arms from bending in the direction of the array of the plurality of hammer arms.

Structural Example 15

A keyboard device including:
the hammer unit of Structural Example 1;
the plurality of keys; and
the keyboard chassis.

Structural Example 16

An electronic keyboard instrument including:
the keyboard device of Structural Example 15; and
a sound emitting section which emits a sound in response to a key depression operation.

While the present invention has been described with reference to the preferred embodiments, it is intended that the invention be not limited by any of the details of the description therein but includes all the embodiments which fall within the scope of the appended claims.

What is claimed is:

1. A hammer unit for a keyboard instrument, the hammer unit comprising:

a plurality of hammer arms each of which is configured to be operated in response to a key depression operation which is performed on a respective key from among a plurality of keys of the keyboard instrument to apply an action load to the respective key, the hammer arms being configured to be mounted such that longitudinal directions of the hammer arms are the same as longitudinal directions of their respective keys, the longitudinal directions being perpendicular to an array direction of the plurality of keys, and widths of the respective hammer arms being shorter than intervals at which the plurality of keys are arranged along the array direction; and a hammer connecting section which (i) has a length corresponding to a length in the array direction of the plurality of keys, and (ii) is connected, by elastically deformable supporting sections, to the plurality of hammer arms to support the plurality of hammer arms in an arrayed state, wherein the hammer connecting section comprises mounting sections by which the hammer connecting section is configured to be mounted to a keyboard chassis of the keyboard instrument, each of the mounting sections being provided between two adjacent ones of the hammer arms along the array direction, and an area and a width of each of the mounting sections not overlapping with widths of the two adjacent ones of the hammer arms between which it is provided.

2. The hammer unit according to claim 1, wherein each hammer arm includes a contacting section with which its respective key comes in contact in response to the key depression operation performed on its respective key, a weight section which is moved in response to the key depression operation, and a respective one of the elastically deformable supporting sections which projects in a vertical direction that is perpendicular to both the array direction and the longitudinal direction and corresponds to an operation direction of the hammer arm, wherein the hammer connecting section supports the plurality of hammer arms with each hammer arm being spaced apart from an adjacent hammer arm, and wherein the mounting sections of the hammer connecting section are provided in a plurality of areas which are located in the direction of the array and in which the supporting sections are not provided.

3. The hammer unit according to claim 2, wherein the elastically deformable supporting section is provided between the contacting section and the weight section of the hammer arm.

4. The hammer unit according to claim 3, wherein the hammer arm is rotated in response to the key depression operation such that the contacting section is moved downward along the vertical direction and the weight section is moved upward along the vertical direction with the elastically deformable supporting section as a center.

5. The hammer unit according to claim 2, wherein the plurality of hammer arms are displaced by their respective elastically deformable supporting sections.

6. The hammer unit according to claim 1, wherein the plurality of hammer arms, the elastically deformable supporting sections, and the hammer connecting section are integrally provided and formed of synthetic resin.

7. The hammer unit according to claim 1, wherein a number of the mounting sections of the hammer connecting section is smaller than a number of the plurality of hammer arms.

8. The hammer unit according to claim 7, wherein the mounting sections comprise screw holes and are configured to be mounted to the keyboard chassis by screws.

9. The hammer unit according to claim 7, wherein the mounting sections comprise one of engagement hooks and locking sections which lock the engagement hooks, and are configured to be mounted to the keyboard chassis by the other of the engagement hooks and the locking sections which lock the engagement hooks.

10. The hammer unit according to claim 2, wherein each elastically deformable supporting section projects upward along the vertical direction from its respective hammer arm, and the hammer connecting section is arranged above the plurality of hammer arms.

11. The hammer unit according to claim 2, wherein each elastically deformable supporting section projects downward along the vertical direction from its respective hammer arm, and the hammer connecting section is arranged below the plurality of hammer arms.

12. The hammer unit according to claim 1, wherein the hammer connecting section comprises reinforcement sections which inhibit the plurality of hammer arms from bending in the array direction.

13. A keyboard device comprising:

the hammer unit according to claim 1;

the plurality of keys; and the keyboard chassis.

14. An electronic keyboard instrument comprising:

the keyboard device according to claim 13; and a sound emitting section which emits a sound in response to a key depression operation.

15. The hammer unit according to claim 1, wherein each hammer arm includes a contacting section with which its respective key comes in contact in response to the key depression operation performed on its respective key, and a weight section which is moved in response to the key depression operation, and wherein each of the elastically deformable supporting sections is provided between the contacting section and the weight section of a respective one of the hammer arms.

16. The hammer unit according to claim 1, wherein the hammer connecting section has a substantially planar shape, and wherein each of the mounting sections comprises a mounting hole provided through the hammer connecting section.

17. The hammer unit according to claim 16, wherein each of the elastically deformable supporting sections is provided so as to project upward along the vertical direction from a respective one of the hammer arms, and wherein the hammer connecting section is configured to be mounted to the keyboard chassis by screws inserted downward along the vertical direction through the mounting holes.

* * * * *